US009318810B2

(12) United States Patent
Zelenski

(10) Patent No.: US 9,318,810 B2
(45) Date of Patent: Apr. 19, 2016

(54) RING FOCUS ANTENNA

(71) Applicant: Winegard Company, Burlington, IA (US)

(72) Inventor: Alexander Anatoli Zelenski, Burlington, IA (US)

(73) Assignee: Wineguard Company, Burlington, IA (US)

( * ) Notice: Subject to any disclaimer, the term of this patent is extended or adjusted under 35 U.S.C. 154(b) by 87 days.

(21) Appl. No.: 14/503,737

(22) Filed: Oct. 1, 2014

(65) Prior Publication Data

US 2015/0091768 A1 Apr. 2, 2015

Related U.S. Application Data

(60) Provisional application No. 61/885,875, filed on Oct. 2, 2013.

(51) Int. Cl.

| | |
|---|---|
| ***H01Q 13/00*** | (2006.01) |
| ***H01Q 19/19*** | (2006.01) |
| ***H01Q 13/02*** | (2006.01) |
| ***H01Q 19/13*** | (2006.01) |

(52) U.S. Cl.

CPC ..... *H01Q 19/193* (2013.01); *H01Q 13/02* (2013.01); *H01Q 13/0208* (2013.01); *H01Q 19/134* (2013.01)

(58) Field of Classification Search

USPC ..... 343/781 CA, 781 P, 840

See application file for complete search history.

(56) References Cited

U.S. PATENT DOCUMENTS

| | | | | |
|---|---|---|---|---|
| 3,162,858 | A | 12/1964 | Cutler | |
| 6,107,973 | A * | 8/2000 | Knop | H01Q 17/001 343/781 CA |
| 6,137,449 | A * | 10/2000 | Kildal | H01Q 1/42 343/781 CA |
| 6,697,028 | B1 * | 2/2004 | Gothard | H01Q 19/191 343/781 CA |
| 6,724,349 | B1 | 4/2004 | Baird et al. | |
| 7,408,522 | B2 | 8/2008 | Ahn et al. | |

(Continued)

FOREIGN PATENT DOCUMENTS

| | | |
|---|---|---|
| EP | 0102846 A1 | 3/1984 |
| EP | 1128468 A2 | 8/2001 |

OTHER PUBLICATIONS

David C. Jenn, et al., Small Efficient Axially Symmetric Dual Reflector Antennas, article, IEEE Transactions on Antennas and Propagation, vol. 41, No. 1, Jan. 1993, pp. 115-117.

(Continued)

*Primary Examiner* — Tan Ho

(74) *Attorney, Agent, or Firm* — Dorr, Carson & Birney PC

(57) ABSTRACT

An antenna includes a main reflector with a focal circle about an axis. A waveguide horn extends from the main reflector along this axis. A sub-reflector is mounted beyond the distal end of the waveguide horn with an annular gap remaining between the sub-reflector and the distal end of the waveguide horn. The annular gap forms a radial transmission line between a first wall on the sub-reflector and a second wall having outer annular corrugated surfaces on the distal end of the waveguide horn. The first wall of the transmission line is a body of revolution of elliptical shape on the sub-reflector. This ellipse is tilted at an angle with respect to the axis, and has a first focal point on the axis. The other focal point is preferably on or near the focal circle. The phase center of the waveguide horn does not coincide with either foci.

19 Claims, 8 Drawing Sheets

(56) References Cited

U.S. PATENT DOCUMENTS

2005/0099350 A1* 5/2005 Gothard ..... H01Q 19/193 343/781 CA
2006/0082513 A1* 4/2006 Kralovec ..... H01Q 13/0266 343/781 CA

OTHER PUBLICATIONS

Sandip Sankar Roy, et al., High Efficiency Mobile Ground Station Antenna using Displaced Ellipse Reflector, article, Special Issue of International Journal of Computer Applications (0975-8887) on Electronics, Information and Communication Engineering—ICEICE No. 3, Dec. 2011, pp. 1-3.

Aluizio Prata, Jr., et al., Displaced-Axis-Ellipse Reflector Antenna for Spacecraft Communications, article, Proceedings SBMO/IEEE MTT-S IMOC 2003, vol. 1, pp. 391-395, 5 pages.

* cited by examiner

RING FOCUS ANTENNA

RELATED APPLICATION

The present application is based on and claims priority to the Applicant's U.S. Provisional Patent Application 61/885,875, entitled "Ring Focus Antenna," filed on Oct. 2, 2013.

BACKGROUND OF THE INVENTION

1. Field of the Invention

The present invention relates generally to the field of antennas. More specifically, the present invention discloses a dish antenna with a ring focus suitable for use in satellite broadcasting.

2. Statement of the Problem

Parabolic reflector antennas are widely used in the field of satellite television broadcasting. With the improvements in receiving/transmitting equipment used on the satellites, more powerful beams are transmitted to the ground and that in turn allows the use of smaller antennas than those used before. Axis-symmetrical dual reflector antennas, especially ring focus antennas, occupy less volume and are preferable for use in mobile applications, such as on recreational vehicles, automobiles, small boats, or in portable antenna systems. At the same time, smaller reflector antennas usually have decreased efficiency relative to larger ones due to a variety of reasons, including spillover and the comparably large shadow from the feed or sub-reflector.

The prior art in this field includes a number of axially-symmetric ring focus antennas. For example, U.S. Pat. No. 3,162,858 (Cutler) discloses an axially-symmetric ring focus antenna that has low noise and high gain. Its feed has a radial transmission line that evenly distributes energy in the aperture and provides lower spillover. However, its feed has a complicated tuning mechanism that would be difficult to manufacture (e.g., by casting) in mass production due to the shape of deep annular corrugations 40 on the surfaces of the transmission line. Also, this antenna requires the size of the reflector to be at least ten times the diameter of the antenna feed. Furthermore, having corrugations 40 on both surfaces of the radial transmission line delivers a cosine-shaped peak intensity of the signal to the primary reflector. As a result, the periphery of the reflector (having the largest surface area) is not illuminated evenly with the middle section of the reflector, which results in lower aperture efficiency of the antenna.

U.S. Pat. No. 6,724,349 (Baird et al.) shows another example of an axis-symmetrical antenna with a feed that would be relatively simple to manufacture, has low spillover and a low level of polarization. This antenna includes a multimode circular waveguide horn with a series of different size cross-sections to improve the radiation patterns of the horn itself. But, the feed is not made to be used in ring focus antennas and radiation from the horn is partially blocked by the sub-reflector, which would reduce the efficiency of the antenna.

Prata et al., "Displaced-Axis-Ellipse Reflector Antenna for Spacecraft Communications" disclose another axis symmetrical antenna of very high efficiency (90%) with a small size sub-reflector (3.3 wavelength). But, the size of the main reflector is about 30 wavelengths and is therefore too large to be used for mobile antennas. The primary reflector is deep enough to allow the phase center of the horn to be aligned with the focal point of the ellipse used to shape the sub-reflector but again, that results in increased size of the antenna.

U.S. Pat. No. 7,408,522 (Ahn et al.) shows another antenna of greatly reduced size implementing an axis-symmetrical antenna of the same general type (axial displaced ellipse, or ADE) as Prata et al. This antenna has aperture efficiency at the level of 60-65%, which is lower than Prata et al. due to the size of the sub-reflector and feed being larger relative to the size of the main reflector and its inability to illuminate the surface of the main reflector evenly to achieve higher aperture efficiency due to parameters chosen for the design of the feed parts.

Thus, there remains a need for an antenna to address these shortcomings in the prior art, and in particular a small high-efficiency antenna that can be easily manufactured.

SUMMARY OF THE INVENTION

The present invention provides a high-efficiency antenna for use in mobile and portable satellite antenna systems that is capable of receiving/transmitting circularly and linearly polarized signals. The antenna includes a concave main reflector of a generally parabolic shape having a focal circle about an axis. A circular waveguide horn extends from the main reflector concentric with this axis. A sub-reflector is mounted beyond the distal end of the waveguide horn with an annular gap remaining between the sub-reflector and the distal end of the circular waveguide horn.

This annular gap can be viewed as forming a radial transmission line between a first wall on the sub-reflector and a second wall having outer annular corrugated surfaces on the distal end of the waveguide horn. The first wall of the transmission line is a body of revolution of elliptical shape on the sub-reflector. This ellipse is tilted at an angle with respect to the axis, and has a first focal point on the axis. The other focal point of the elliptically-shaped first wall is preferably on or near the focal circle of the main reflector. The phase center of the waveguide horn does not coincide with either foci.

The second wall of the transmission line has a progressive series of corrugations or chokes that extend radially outward from the edge of the circular waveguide horn. For example, the second wall can be made with annular quarter wavelength or irregular individual depth corrugations and can be shaped using second or higher order curves.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which.

DETAILED DESCRIPTION OF THE INVENTION

Figure 1:
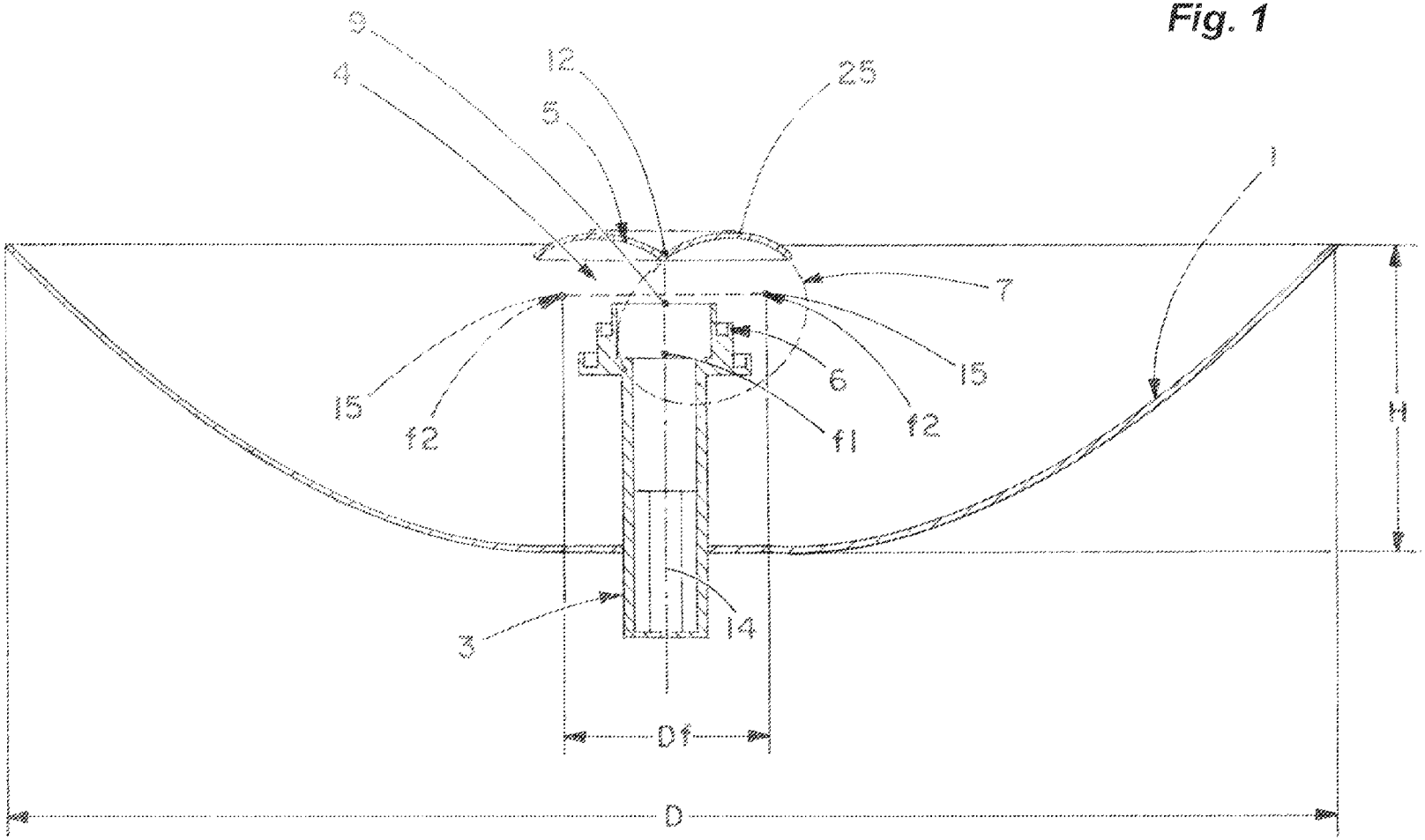
FIG. 1 is a side cross-sectional view of an embodiment of the present antenna.
Figure 2:
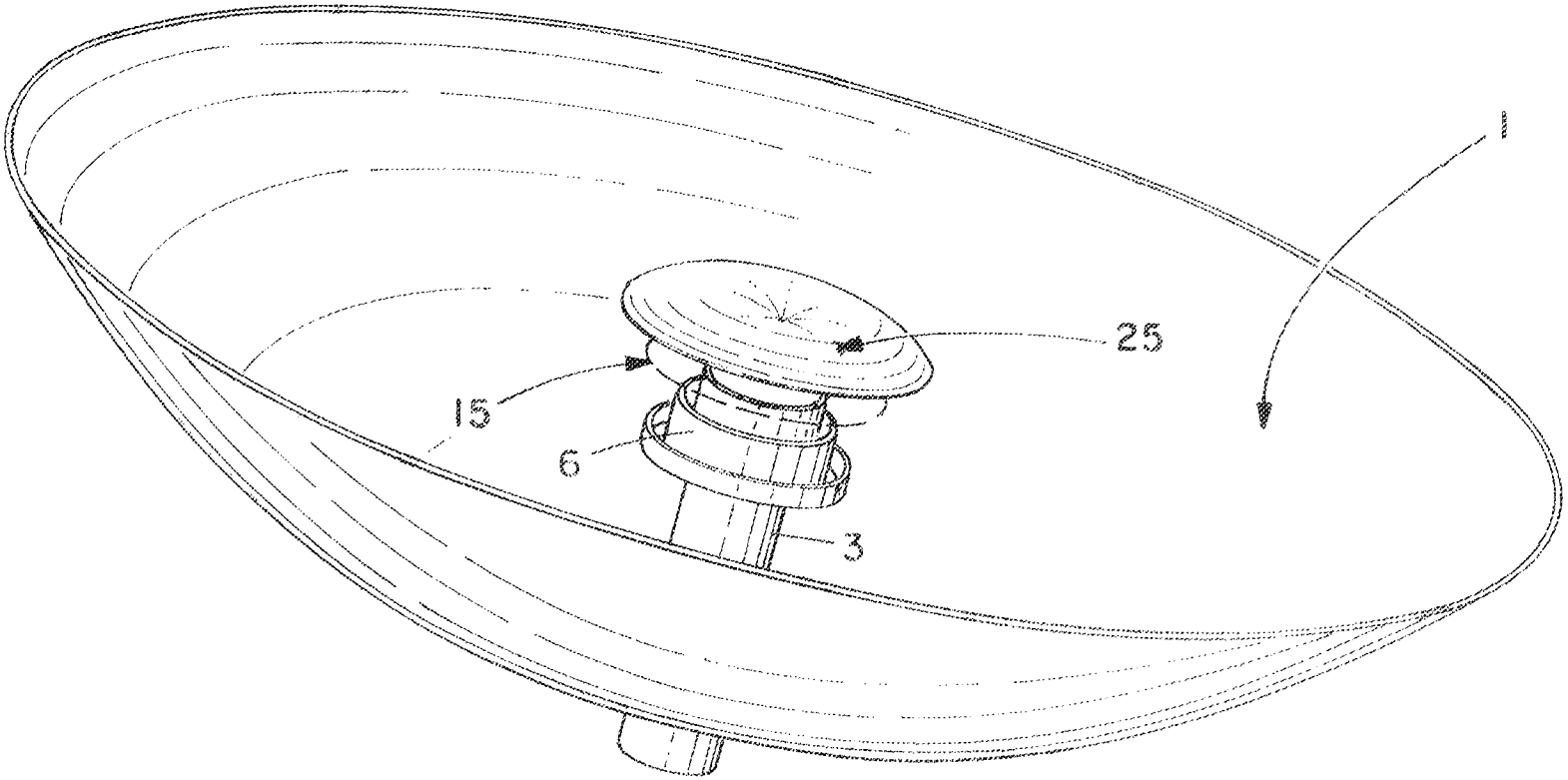
FIG. 2 is an axonometric view of the antenna corresponding to FIG. 1.

FIG. 1 is a side cross-sectional view of an embodiment of the present antenna and FIG. 2 is a corresponding axonometric view of this antenna. In this embodiment, the concave main reflector 1 has a surface of revolution about an axis of symmetry 14 that is parallel to, and offset from the parabola axis. This results in the main reflector 1 forming a circular focal ring 15 having a diameter, Df. In other words, the main reflector 1 can have a conventional axial displaced ellipse (or ADE) configuration as discussed above.

The feed element consists of a circular waveguide horn 3 extending from the main reflector 1 concentric with the axis 14 of the main reflector 1. In general, all of the elements of the antenna are concentric about this common axis 14 in this embodiment. The circular waveguide horn 3 can be a single mode or have different sequentially increasing in diameter cross-sections along the axis of propagation to allow multiple waveguide modes and thereby provide more control over the antenna pattern.

Similar to a conventional ADE antenna, a sub-reflector 25 is mounted beyond the distal end of the waveguide horn 3, so that an annular gap remains between the sub-reflector 25 and the distal end of the waveguide horn 3, as shown in FIG. 1. In the present invention, this annular gap can be viewed as forming an annular transmission line 4 between the sub-reflector 25 and outer annular surfaces on the distal end of the waveguide horn 3, as depicted in FIG. 1. In particular, the under-surface of the sub-reflector 25 forms a first wall 5 of a transmission line 4. The shape of this first wall 5 is defined by a body of revolution of an ellipse 7 about the axis 14. The apex 12 of this elliptical surface of the first wall 5 coincides with the axis of symmetry 14. The large axis of this ellipse 7 is inclined to the axis of symmetry 14 by an angle β. One of the foci f1 of the ellipse 7 is located on the axis of symmetry 14 and the other focal point f2 preferably lies on or near the circular focal ring 15 of the main reflector 1. The outer diameter of the first wall 5 of the radial transmission line 4 can be larger than the diameter (Df) of the focal circle 15 of the main reflector 1, preferably by about 5-25%.

In one embodiment of the present invention, the distance (d) between the foci f1 and f1 is selected with the diameter (Df) of the focal circle being about 1.1-1.6 lambda (free space wavelength), and the diameter (D) of the main reflector being about 8-25 lambda. The angle of inclination β of the ellipse 7 with respect to the axis of symmetry 14 should be in the range of about 55-80 degrees.

The opposing second wall 6 of the transmission line 4 is formed by the progressive series of annular corrugations or chokes on the outer aspect of the circular waveguide horn 3 adjacent to its distal end, that extend radially outward about its distal end from the axis 14. In other words, the annular corrugations are centered about the axis 14 adjacent to the distal end of the circular waveguide horn 3. The annular corrugations are parallel to the axis 14 and the surface of the aspect of the circular waveguide horn 3 is also inclined toward the main reflector 1 as illustrated in FIG. 1. When viewed in this cross-sectional plane, the series of outer vertices or corners defined by the corrugations in the second wall 6 follow a second order curve (e.g., an ellipse, parabola or hyperbola), but higher order curves or a flat surface can be used as well. The outer diameter of the second wall 6 is preferably smaller than the diameter (Df) of the focal circle 15 of the main reflector 1.

As indicated in FIG. 1, the circular waveguide horn 3 has a phase center 9 that does not coincide with the either focal point f1 or f2 of the ellipse 7, but instead the phase center 9 is generally located on the axis 14 somewhere between the first focal point f1 and the plane of the focal ring 15. The proximal end of the circular waveguide horn 3 is coupled on one side to a receiving/transmitting device (not shown). For purposes of easy visualization, the antenna system will be explained operating as a transmitting antenna, although the present antenna can be employed for both transmitting and receiving.

As mentioned above, the distal end of the waveguide horn 3 is coupled through the gap to the transmission line 4 so the signal from the transmitter propagates inside the circular waveguide horn 3 through the gap and into the transmission line 4. The transmission line 4 effectively has a toroidal aperture formed by the first wall 5 and second wall 6 directing the signal onto the main reflector 1. The elliptical shape of the first wall 5 creates a focal ring co-located with the focal ring 15 of the main reflector 1.

It should be noted that the first wall 5 does not have any corrugations or chokes. In the absence of the corrugated second wall 6, a uniform signal front of a signal wave radiated radially from the transmission line 4 onto the main reflector 1 would not have an intensity distribution that is almost even across the aperture with a rapid drop in amplitude toward the periphery of the main reflector 1. Instead, a peak of intensity would be directed to the middle part of the reflector surface that slowly decreases toward the periphery and the center of the main reflector 1. This would result in an undesirable drop in efficiency of the antenna.

In contrast, the present invention employs a corrugated second wall 6 which, together with the shape of the first wall 5, shift the peak of intensity from the middle part of the main reflector 1 toward its periphery, and at the same time deliver a rapid drop in amplitude toward the edge of the main reflector 1. This results in an almost even distribution of intensity across the aperture, and thereby provides high antenna gain with low side lobes. The design and configuration of the annular corrugations on the surface of the second wall 6 allow selective adjustment of the energy distribution on the surface of the main reflector 1. For example, the corrugations can be designed as quarter wavelength choke rings. The depth of individual corrugations can be set individually to adjust the feed for optimal performance across the desired frequency band.

As the phase center 9 of the circular waveguide horn 3 in not aligned with the focal center f1 of the first wall 5 of the radial transmission line 4, this pair does not work as a normal sub-reflector-horn pair do in conventional ADE antennas and the rules of ray tracing of physical optics are not applicable. Unless the corrugated second wall 6 is included as part of the transmission line 4, the signal front radiated from the feed is out of phase and results in poor performance of the antenna. However, in the present invention, including the second wall 6 as part of the radial transmission line 4 results in overall high aperture efficiency of the antenna.

Figure 3:
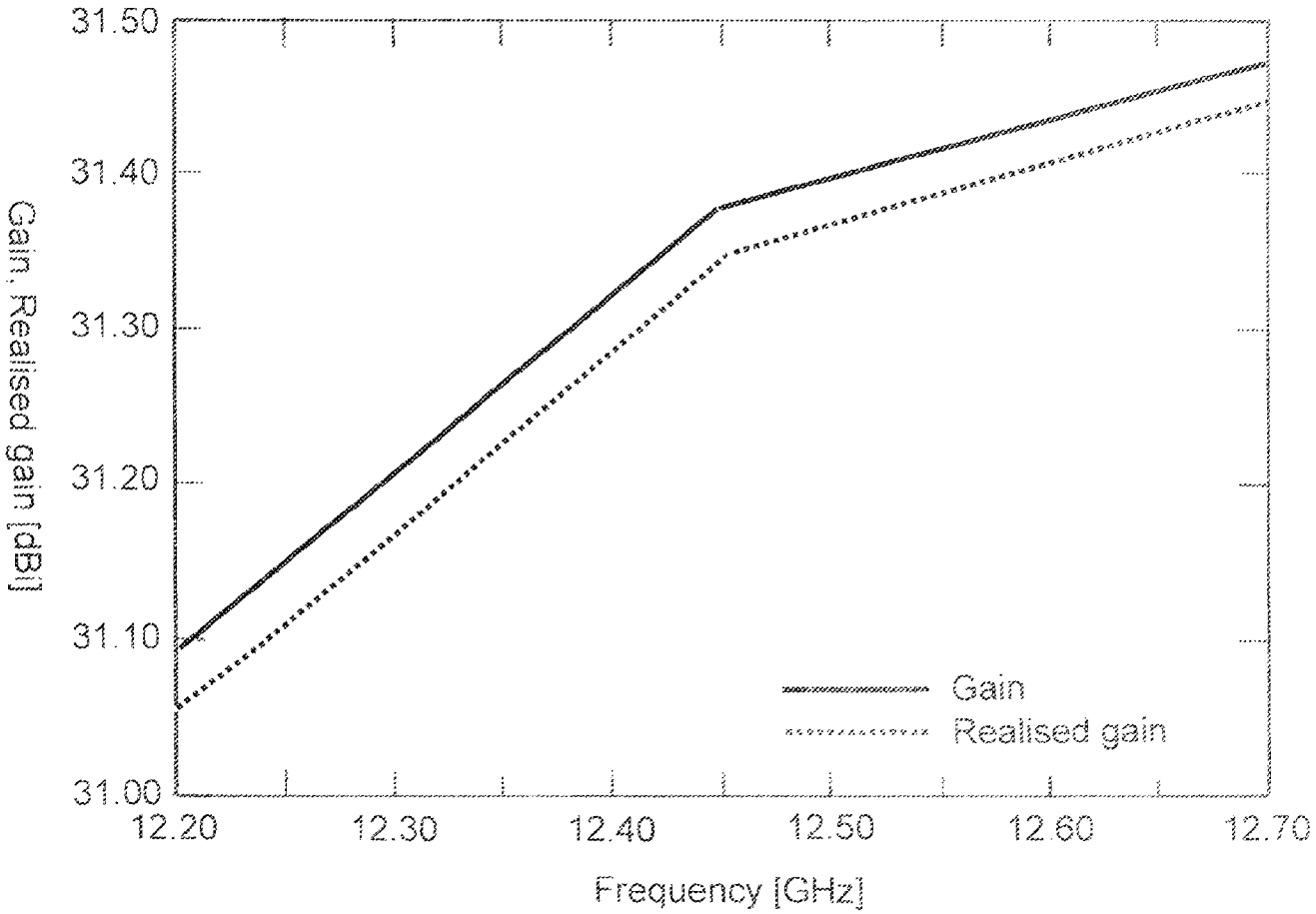
FIG. 3 is a graph illustrating the simulated gain the antenna.

FIG. 1 shows a cross-section of an antenna with a main reflector 1 having an outer diameter (D) of about 14.25 in. Realized gain, simulated using numerical methods (method of moments, FEKO) at the middle frequency 12.45 GHz of the DBS frequency band (12.2-12.7 GHz), reaches about 31.3 dB, which is an equivalent of 79.8% aperture efficiency. Simulations were done for circular polarization and the results include losses in the polarizer inside the circular waveguide horn 3 but do not account for losses in the material and losses due to surface deviation from theoretical due to tolerances in manufacturing. Another implementation of the same invention in a 12.5 in. diameter antenna resulted in the gain of 31.34 dB (shown on FIG. 3), which corresponds to 79.2% aperture efficiency.

The distance (L) from the phase center 9 of the circular waveguide horn 3 to the apex 12 of the first wall 5 of the transmission line 4 is very important and preferably should be not less than 0.4 wavelength. Changing the inclination (angle β) of the ellipse 7 relative to the axis of symmetry 14 allows regulation of the signal intensity at the aperture of the transmission line 4 to the reflector 1. In addition to that, and for the same purpose, the shape of the second wall 6 of the transmission line 4 can be used to regulate distribution of energy across the surface of the main reflector 1, as previously noted.

It was noticed that generally increasing the distance between the first and second walls 5, 6 of the transmission line 4 toward the aperture results in higher surface efficiency of the antenna. Preferably, the distance between the outer edges of the first and second walls 5, 6 should be about 0.8-1.5 lambda.

Figure 4:
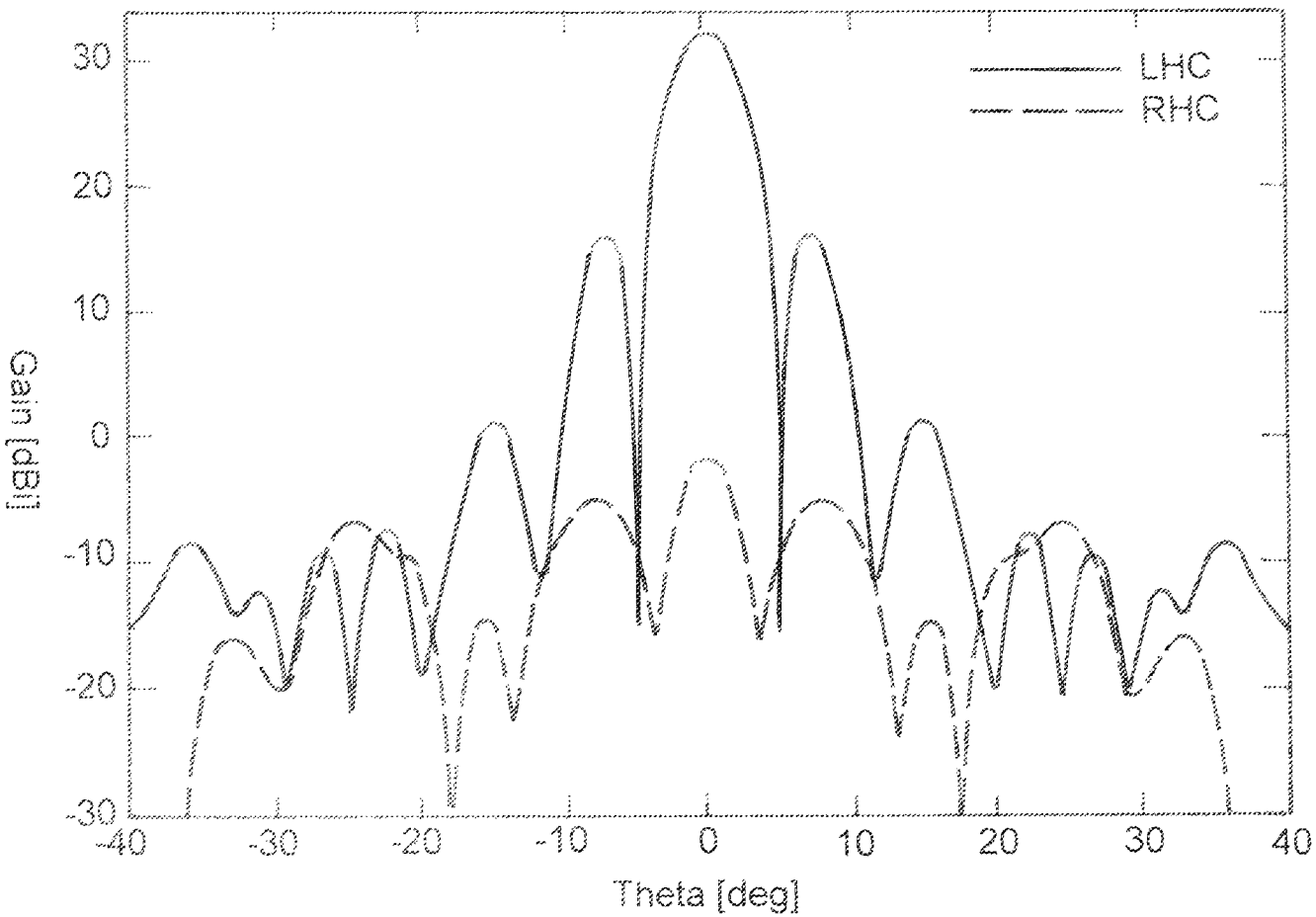
FIG. 4 is a graph illustrating simulated gain of the antenna for left and right hand circular (LHC and RHC) polarization.

In a practical implementation for a 14.25 in. antenna diameter, an angle β of about 60 degrees was found to offer the highest efficiency. However, angles of inclination ranging from about 55-80 degrees should be acceptable. The annular gap for this antenna (distance L) is 0.474029 in., or 0.5 lambda. Preferably, the eccentricity of the ellipse 7 should range between 0.65 and 0.9. In this specific embodiment, the major and minor semi-axes of the ellipse 7 are a=2.191 and b=1.785, which corresponds to eccentricity of 0.815. The distance between the foci of the elliptical shape of the first wall is 1.27 in., which corresponds to 1.334 lambda. In order to limit spillover, the outer diameter (d) of the first wall 5 is set at 2.75 in., which is 2.9 lambda. Because the focal circle (phase circle) of the radial transmission line 4 is more of a torus than a circle, it also helps to redirect energy toward the main reflector 1 and create a level drop on its edge. Preferably, the outer diameter (d) of the first wall is about 25% larger than the diameter (Df) of the focal ring 15 of the main reflector 1. The distance from the outer edge of the first wall 5 to the outer edge of the second wall 6 is 1.1275 in. (1.189 lambda). FIG. 4 depicts a pattern of this 14-inch antenna. Side lobes level at −16 db are typically acceptable for a tracking antenna in mobile applications.

Figure 5:
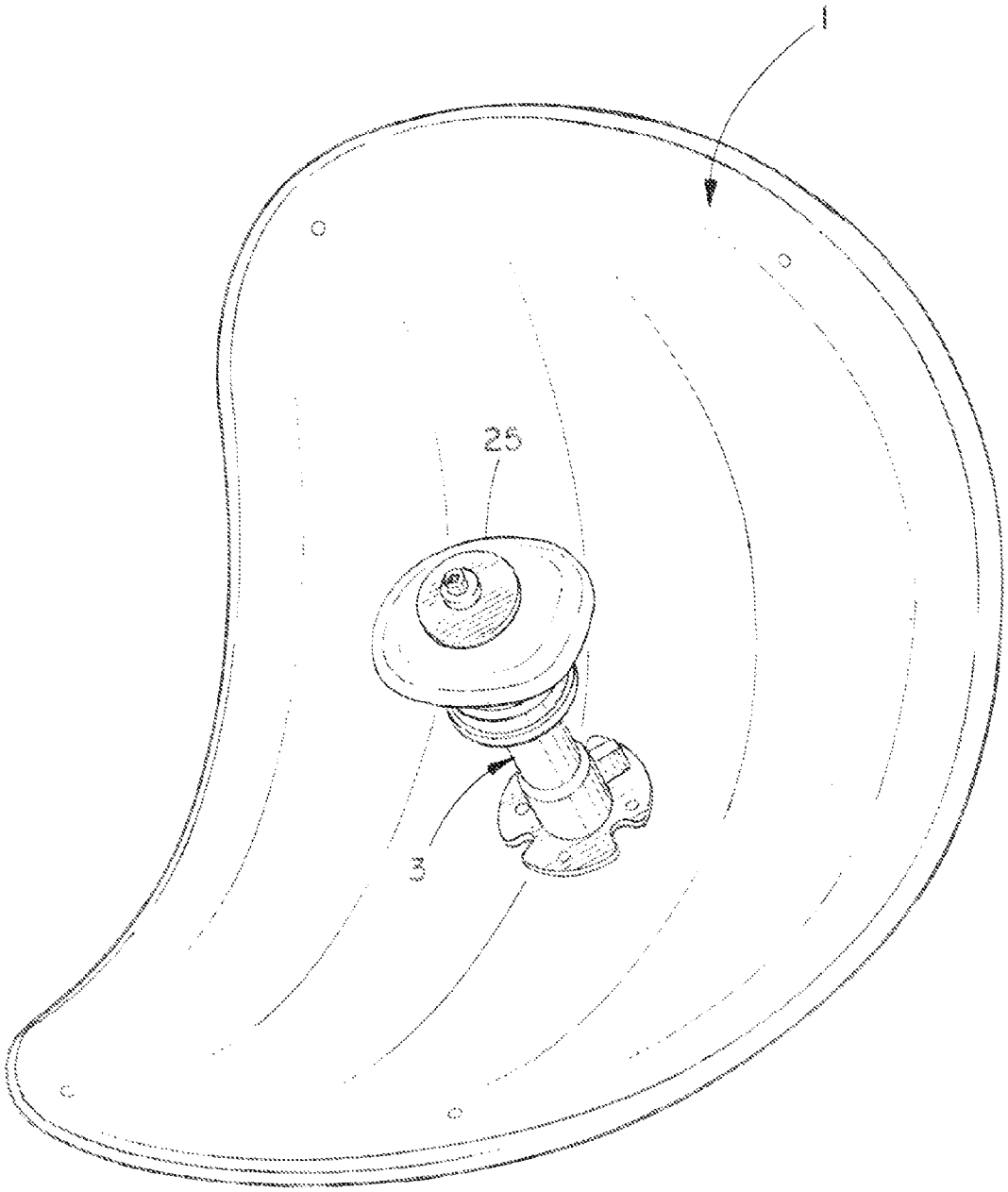
FIG. 5 is an axonometric view of an alternative embodiment of the present antenna.
Figure 6:
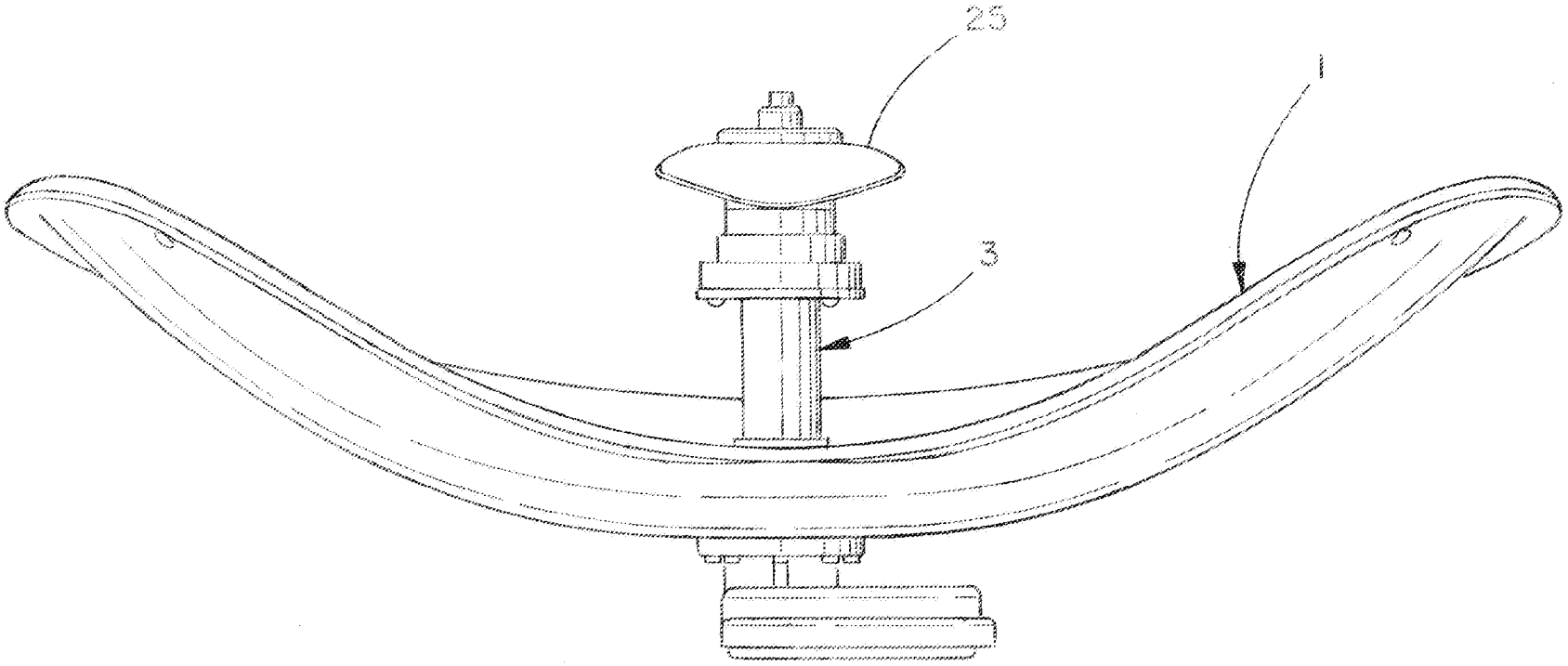
FIG. 6 is a bottom view corresponding to FIG. 5
Figure 7:
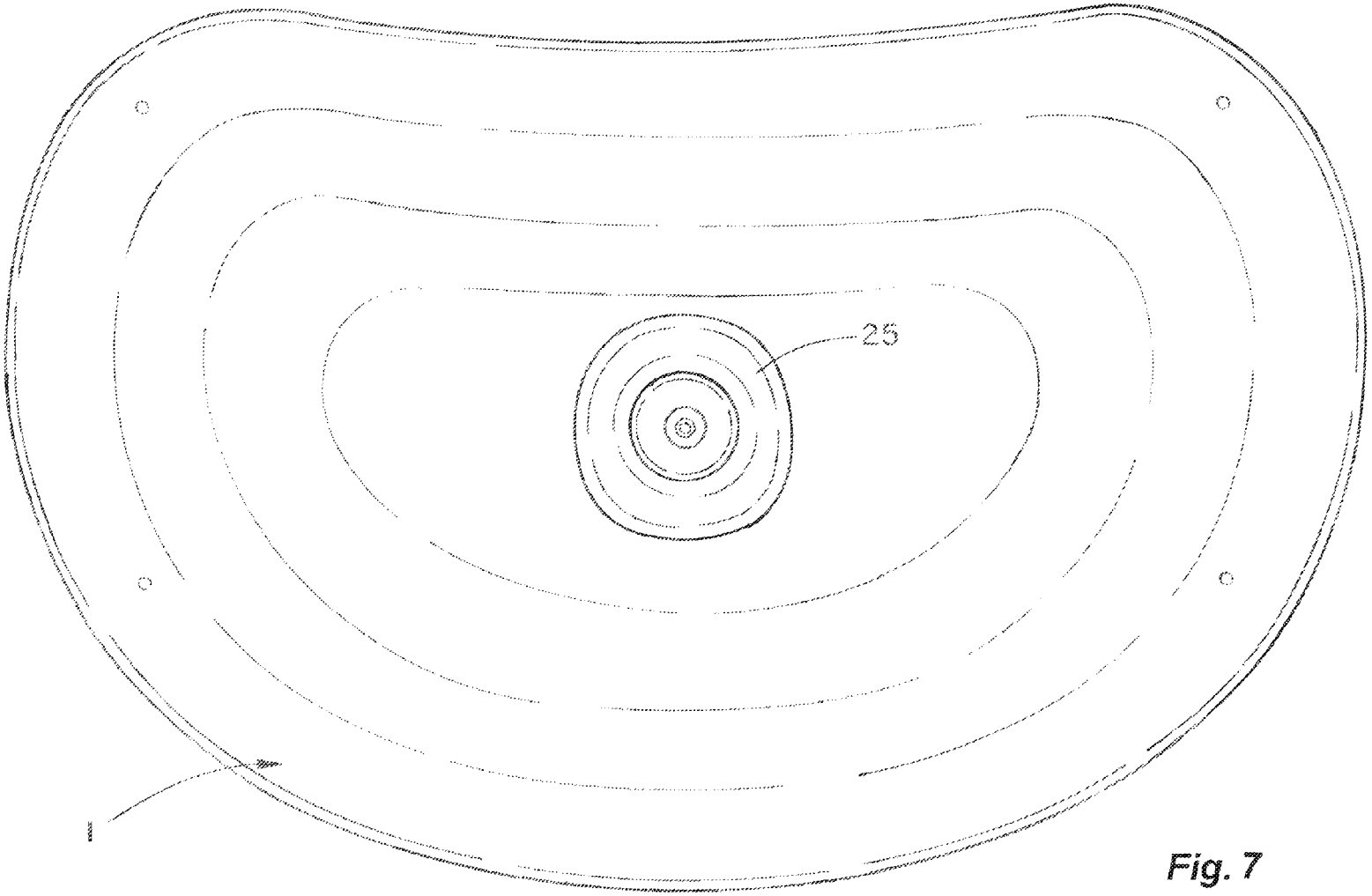
FIG. 7 is a front view corresponding to FIG. 5.
Figure 8:
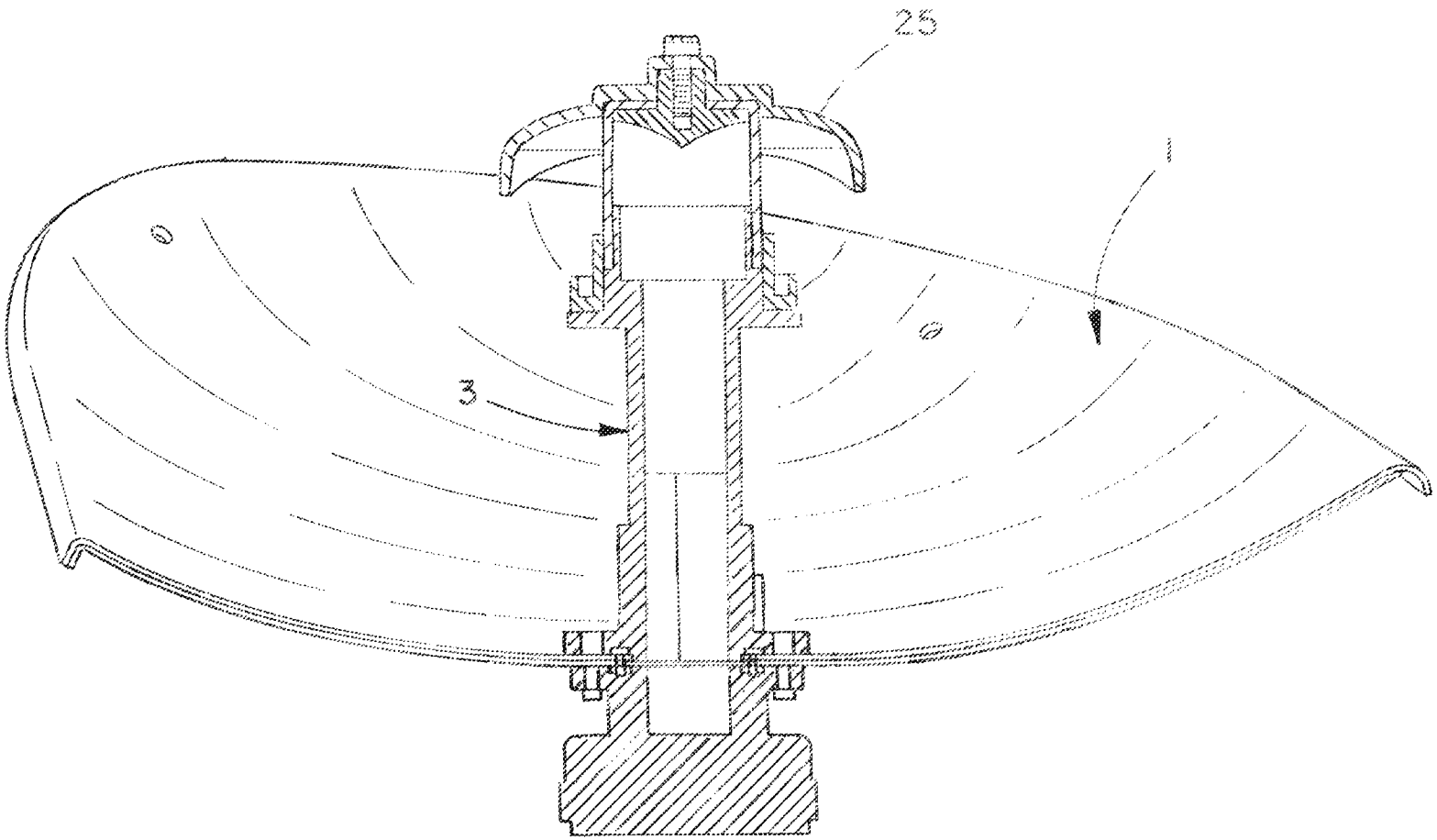
FIG. 8 is a cross-sectional view corresponding to FIG. 5.

FIGS. 5-8 illustrate an alternative embodiment of the present invention having asymmetrical reflectors 1 and 25 that are more suitable to enclosure within a protective dome. In particular, FIG. 5 is an axonometric view of this alternative embodiment. FIG. 6 is a corresponding bottom view. FIG. 7 is a corresponding front view and FIG. 8 is a corresponding cross-sectional view. Although the main reflector 1 is no longer radially symmetrical about the axis, it is still shaped to provide a circular focal ring about the axis, as discussed above. The sub-reflector 25 is also asymmetrical, but still includes an elliptical surface to create a first wall as discussed above.

The upper and lower portions of the main reflector 1 are truncated in this embodiment primarily to save space, which is a major concern in designing a portable antenna system. This configuration is particularly advantageous is saving space if the main reflector 1 is housed within a compact hemispherical dome for protection. However, this also results in an antenna pattern that is not radially uniform about the central axis 14 since the main reflector is no longer radially symmetrical. To compensate, the sub-reflector 25 is equipped with enlarged upper and lower peripheral ears or extensions, so that the sub-reflector 25 is more saddle-shaped, rather than being circular as shown in the first embodiment. The upper and lower extensions of the sub-reflector 25 are shaped to compensate for the absence of truncated portions of the main reflector 1 by increasing illumination of the more-central upper and lower regions of the main reflector 1 that remain. This helps to equalize performance of the antenna in all directions.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

I claim:

1. An antenna comprising:

a main reflector being a concave body having a focal circle centered about an axis extending from the main reflector;

a waveguide horn extending from the main reflector along the axis to a distal end;

a sub-reflector mounted beyond the distal end of the waveguide horn with an annular gap remaining between the sub-reflector and the distal end of the waveguide horn; said sub-reflector having an elliptical shape extending as a body of revolution about the axis, with one focal point of the sub-reflector on the axis;

wherein the phase center of the waveguide horn does not coincide with either foci of the sub-reflector; and a progressive series of annular corrugated surfaces extending radially outward from the distal end of the waveguide horn.

2. The antenna of claim 1 wherein the sub-reflector defines a first wall and the corrugated surfaces define a opposing second wall to form a radial transmission line therebetween with a toroidal aperture directing the signal from the waveguide horn toward the main reflector.

3. The antenna of claim 1 wherein the contour of the corrugated surfaces follow at least a second order curve.

4. The antenna of claim 1 wherein the elliptical shape defined by the sub-reflector is inclined at an angle with respect to the axis.

5. The antenna of claim 1 wherein the second focal point of the sub-reflector is located on the focal circle of the main reflector.

6. The antenna of claim 1 wherein the sub-reflector and waveguide horn define a phase center that coincides with the second focal point of the sub-reflector.

7. The antenna of claim 1 wherein the main reflector has a substantially parabolic shape.

8. The antenna of claim 1 wherein the main reflector has at least one truncated peripheral portion.

9. The antenna of claim 8 wherein the sub-reflector further comprises at least one peripheral extension compensating for the truncated peripheral portion of the main reflector.

10. The antenna of claim 1 wherein the corrugated surfaces comprise a series of choke rings.

11. The antenna of claim 1 wherein the corrugated surfaces are shaped to provide a region of peak signal intensity toward the periphery of the main reflector.

12. An antenna comprising:

a main reflector being a concave body having a focal circle centered about an axis extending from the main reflector;

a waveguide horn extending from the main reflector along the axis to a distal end;

a sub-reflector mounted beyond the distal end of the waveguide horn with an annular gap remaining between the sub-reflector and the distal end of the waveguide horn; said sub-reflector having an elliptical shape extending as a body of revolution about the axis, with one focal point of the sub-reflector on the axis; wherein the phase center of the waveguide horn does not coincide with either foci of the sub-reflector; and a progressive series of annular corrugated surfaces extending radially outward from the distal end of the waveguide horn to form a radial transmission line between the sub-reflector and the corrugated surfaces with a toroidal aperture directing the signal from the waveguide horn toward the main reflector.

13. The antenna of claim 12 wherein the contour of the corrugated surfaces follow at least a second order curve.

14. The antenna of claim 12 wherein the elliptical shape defined by the sub-reflector is inclined at an angle with respect to the axis.

15. The antenna of claim 12 wherein the second focal point of the sub-reflector is located on the focal circle of the main reflector.

16. The antenna of claim 12 wherein the sub-reflector and waveguide horn define a phase center that coincides with the second focal point of the sub-reflector.

17. The antenna of claim 12 wherein the main reflector has a substantially parabolic shape.

18. The antenna of claim 12 wherein the corrugated surfaces comprise a series of choke rings.

19. The antenna of claim 12 wherein the corrugated surfaces are shaped to provide a region of peak signal intensity toward the periphery of the main reflector.

* * * * *